US009346298B2

(12) United States Patent
Van Der Zwan

(10) Patent No.: US 9,346,298 B2
(45) Date of Patent: May 24, 2016

(54) SINGLE-PASS INKJET PRINTER

(75) Inventor: Rick Van Der Zwan, Bad Iburg (DE)

(73) Assignee: PadaLuma Ink-Jet-Solutions GmbH & Co. KG, Markt Erlbach (DE)

( * ) Notice: Subject to any disclaimer, the term of this patent is extended or adjusted under 35 U.S.C. 154(b) by 128 days.

(21) Appl. No.: 13/701,615

(22) PCT Filed: Jun. 18, 2010

(86) PCT No.: PCT/EP2010/003682
§ 371 (c)(1),
(2), (4) Date: Jan. 10, 2013

(87) PCT Pub. No.: WO2011/157282
PCT Pub. Date: Dec. 22, 2011

(65) Prior Publication Data

US 2013/0100207 A1 Apr. 25, 2013

(51) Int. Cl.
*B41J 25/00* (2006.01)
*B41J 25/308* (2006.01)
*B41J 25/34* (2006.01)

(52) U.S. Cl.
CPC ..... *B41J 25/001* (2013.01); *B41J 25/308* (2013.01); *B41J 25/34* (2013.01); *B41J 2202/20* (2013.01); *B41J 2202/21* (2013.01)

(58) Field of Classification Search
CPC ..... B41J 2002/16591; B41J 2/155; B41J 2/2146; B41J 2/515; B41J 2202/21
See application file for complete search history.

(56) References Cited

U.S. PATENT DOCUMENTS

| | | | | |
|---|---|---|---|---|
| 4,940,998 | A * | 7/1990 | Asakawa | 347/37 |
| 6,272,986 | B1 * | 8/2001 | Hess | 101/137 |
| 6,315,380 | B1 | 11/2001 | Yokoi | |
| 7,578,578 | B2 * | 8/2009 | Akahane | B41J 2/145 347/19 |
| 2005/0270329 | A1 | 12/2005 | Hoisington et al. | |
| 2008/0273910 | A1 | 11/2008 | Verlinden et al. | |
| 2009/0284572 | A1 * | 11/2009 | Katoh | 347/85 |

FOREIGN PATENT DOCUMENTS

| | | | |
|---|---|---|---|
| CN | 1059685 | A | 3/1992 |
| CN | 101143518 | A | 3/2008 |

(Continued)

OTHER PUBLICATIONS

Translation of WO 2008/152903 A1. (WO 2008/152903 A1 was published on Dec. 18, 2008.).*

(Continued)

*Primary Examiner* — Justin Seo
(74) *Attorney, Agent, or Firm* — Mendelsohn Dunleavy, P.C.; Steve Mendelsohn

(57) ABSTRACT

A single-pass inkjet printer is specified with a running path for guiding a printing medium along a running direction and with a number of print-head modules which extend over the running path in a transverse direction. It is provided here that the print-head modules are arranged in each case such that they can be introduced, in a manner which is suspended and self-adjusting, substantially in a vertical direction into a printing position, in which they are fixed to the unit. A single-pass inkjet printer of this type affords the possibility of a simple manual exchange of print-head modules, as a result of which the down times are shortened.

27 Claims, 7 Drawing Sheets

(56) References Cited

FOREIGN PATENT DOCUMENTS

| | | | |
|---|---|---|---|
| CN | 101184627 | A | 5/2008 |
| EP | 0 400 652 | A2 | 12/1990 |
| JP | 4185377 | B2 | 11/2008 |
| TW | 200815198 | A | 4/2008 |
| WO | WO2005108094 | A1 | 11/2005 |
| WO | WO2008152903 | A1 | 12/2008 |

OTHER PUBLICATIONS

International Search Report mailed Apr. 29, 2011 for corresponding PCT Application No. PCT/EP2010/003682.
English Translation of Written Opinion mailed Jan. 20, 2013 for corresponding PCT Application No. PCT/EP2010/003682.
Notification of First Office Action; Mailed Jul. 1, 2014 for corresponding CN Application No. 201080067407.6.

* cited by examiner

SINGLE-PASS INKJET PRINTER

FIELD

The invention relates to a single-pass inkjet printer having a running track for guiding a printing medium along a running direction and having a number of print head modules which extend over the running track in a transverse direction.

BACKGROUND

Whereas, in a conventional inkjet printer, the print heads which are mounted on a carriage spray ink droplets line by line in the transverse direction onto the medium which is transported discontinuously in the running direction, the print heads are mounted in print head modules over the entire width of the medium in the transverse direction in a single-pass inkjet printer. The printing medium can be moved continuously in the running direction. Whereas printing speeds of up to 2 m per minute are reached in a conventional inkjet printer, printing speeds of up to over 50 m per minute can be achieved by way of a single-pass inkjet printer. For color printing, a plurality of print head modules can be mounted behind one another in the running direction in a single-pass inkjet printer. Here, the print head modules are assigned in each case one primary color, in particular cyan, magenta and yellow and possibly black. For special printing uses, print head modules having a special color can be added.

A single-pass inkjet printer is suitable, in particular, for industrial use, in which high-quantity goods have to be printed and a high throughput is therefore important. On account of the high printing speeds, a single-pass inkjet printer is likewise suitable for printing objects with a large surface area. A single-pass inkjet printer is therefore suitable, in particular, for industrial applications of the furniture or ceramic industry, where floor coverings, such as laminates or ceramic tiles, countertops, profiled strips or the like are to be provided with a decorative pattern. Here, a very wide variety of inks are used which are, for example, resistant with respect to a subsequent protective coating, etc.

In comparison with conventional printing processes, such as gravure printing or the like, the single-pass inkjet printer is also used precisely in the case of small production batches, where the production of an impression roll is not worthwhile. In contrast, a single-pass inkjet printer also makes individualization of the decorative patterns possible, and also impossible decorative patterns which cannot be achieved by way of rolls. The single-pass inkjet printer is not restricted to a constant repetition of a printing pattern or repeating pattern, as is the case in rotary printing.

The individual print heads which are combined in the print bar of a print head module can have widths of up to several tens of cm. Here, resolutions of up to 600×600 dpi (dots per inch) are possible. Here, several thousand nozzles are contained per print head. The printing width itself can be up to several meters.

Positional deviations of a few micrometers are visible to the human eye in a printed image. In the case of the above-mentioned resolutions, the individual nozzles of a print head lie only several tens of μm apart from one another. The size of an image point itself is in the region of 10 μm. In a single-pass inkjet printer having a plurality of print head modules which are arranged behind one another in the running direction, it can be seen that an adjustment of the print heads in the micrometer range becomes necessary, in order to produce a high-quality printed image. The adjustment of a print head module in a single-pass inkjet printer is therefore complicated. The position of the print heads has to be detected, for example, by optical microscope and has to be set manually in a complicated way. The configuration of a single-pass inkjet printer is thus comparatively protracted. An adjustment also has to be carried out for each replacement of a print head module. This leads to an unnecessary extension of the down times.

SUMMARY

It is an object of at least one embodiment of the invention to specify a single-pass inkjet printer, in which the configuration and an exchange of a print head module can be performed as quickly as possible. According to the embodiment, this object is achieved for a single-pass inkjet printer of the type mentioned at the outset by virtue of the fact that, hanging in each case substantially in the vertical direction, the print head modules can be moved in a self-adjusting manner into a printing position which is fixed to the unit and are arranged such that they can be removed reversibly in the printing position which is fixed to the unit.

Here, the embodiment proceeds from the consideration that hanging fastening of the print head modules in principle makes facilitated installation and dismantling of the print head modules in the vertical position possible. A hanging print head module can be readily removed from, in particular lifted out of, the printing position which is fixed to the unit, for example, and can be moved into an accessible cleaning or removal position above or below the printing position. At the same time, a hanging arrangement of the print head module permits automatic orientation on account of gravity which acts at the centroid. As a result, during the insertion of the print head module, there is already rough positioning with respect to the subsequent printing position which is fixed to the unit. As a result, the hanging fastening makes self-adjustment into the printing position which is fixed to the unit possible, in particular without complicated mechanical auxiliary constructions, without manual subsequent adjustment becoming necessary. The configuration of any mechanical guide elements is simplified by the automatic positioning of the hanging print head module as a result of gravity, in comparison with complicated positive guides.

In addition to the connection means of a print head module, for example, bearings or guide elements are provided which, during the introduction in a vertical direction, force the print head module into the stipulated printing position. The mechanical elements which are provided for this purpose are configured, in particular, in such a way that merely lowering or raising of the print head module leads to the stipulated printing position being reached. By lowering or raising of the print head module, the latter leaves the printing position and can be returned reversibly into said printing position again in a simple way.

The embodiment is suitable, in particular, for simple mounting of large and heavy print head modules, in which, in addition to the print heads, at the same time the control electronics and optionally an ink tank are accommodated. However, the invention is not restricted in any way to applications of this type.

The print head modules are preferably fastened in each case in an upright state in the printing position which is fixed to the unit. This permits an arrangement of the print head modules which is stable and, in particular, adjusted exactly with respect to the printer. In an upright mounting, in particular, the connection of the or each print head module can be used in a simple way as a defined locating or floating bearing for fixing the end position. In the case of the hanging fastening of the or each print head module, the centroid is accordingly situated below the bearing point of the connection means. In the printing position which is reached and is fixed to the unit, in the case of upright fastening, in contrast, the centroid of the print head module is arranged above a lower bearing point which then results. During the self-adjustment, the print module passes from the hanging position into the final upright position.

The print head modules are preferably fastened in each case in a swinging manner to a raising/lowering device. Via an actuation of the raising/lowering device, the connected print head module is lowered into the printing position, in particular in a self-adjusting manner, and is raised out of said printing position for dismantling. The reverse movement sequence is likewise made possible. Hanging fastening of the print head module on the raising/lowering device permits the necessary degrees of freedom which are necessary for orienting the print head module between its free hanging position and the printing position which is fixed to the unit. The swinging arrangement can be provided in principle by a suitable mechanical connection means. Here, knife-edge bearings or ball socket bearings are likewise conceivable, just like a hanging connection via a flexible connecting part, such as a cable element or the like.

As mentioned, the connection means of the print head module is preferably used as a bearing for fixing the printing position. Here, in one advantageous design variant, the print head modules are connected in each case to the raising/lowering device parallel to the transverse direction and are arranged so as to swing about a polar angle. The orientation parallel to the transverse direction achieves important prepositioning of the print head module. The perpendicular orientation with respect to the running direction of a print head module which extends in the transverse direction is essential for the printing quality which can be achieved. If there is a deviation from the perpendicular angle with respect to the running direction, this leads to an offset of the individual printer dots with respect to the desired position of the image point in the transverse direction. To this end, the connection means for the print head module is configured, for example, as a floating bearing which permits a displacement in the transverse direction, but does not allow any degree of freedom in the running direction. A bearing of this type can be configured, in particular, as a slide guide in the transverse direction, to which slide guide the print head module is connected so as to swing about the polar angle.

In one particularly advantageous refinement, the print head modules are connected to the raising/lowering device in each case via at least two open ball socket bearings which are offset in the transverse direction. As a result of the at least double connection which is offset in the transverse direction, prepositioning of the print head module perpendicularly with respect to the running direction is necessarily achieved. The socket can be configured, for example, as a prism or wedge depression or the like which is open on one side and runs in the transverse direction. The print head module is connected into said socket in each case via a corresponding bearing element which is of conical configuration, for example. In order to make the swinging movement possible, the opening angle of the cone is smaller than that of the prism or wedge depression. The socket is open, in particular, on one side in the transverse direction, with the result that the print head module can be connected into the raising/lowering device in a simple way. To this end, the raising/lowering device is moved into a removal position. From said removal position, the print head modules can then be removed in the transverse direction.

The connection means which is configured in the transverse direction as a floating bearing already per se makes a displacement of the print head module in the transverse direction possible, without its orientation with respect to the running direction being changed. This is advantageous, in particular, during the insertion of the print head module into the printing position, in particular in the case of a lowering operation, to move said print head module in the transverse direction into the stipulated unit position. At the same time, the polar angle of the print head module is fixed via the connection means, by which polar angle the print head module is inclined in the printing position with respect to the vertical direction. An inclination of this type is necessary, in particular, when the printing medium is not moved through in a flat state under the print head modules, but rather on a curved track. A curved track of this type makes, in particular, more exact guidance of the printing medium possible. For example, the printing medium can be tensioned in the printing region via a curved track.

Here, in one preferred refinement, the print head modules are adjusted in the respective printing position in each case perpendicularly with respect to the track course of the printing medium.

The print head modules are preferably additionally fastened to the raising/lowering device such that they can be displaced in each case in the transverse direction. In particular, an additional displacement of this type can be realized by a linear bearing and, in particular, by a rail adjusting system. Via a linear bearing which is oriented in the transverse direction, the connected print head module can be pulled laterally out of the single-pass inkjet printer and can subsequently be removed from its hanging position. The installation of a print head module is of very simple design to this extent and can be carried out extremely quickly. Accordingly, the print head module is mounted on the displaceable part of the linear bearing or of the rail adjusting system. The print head module is introduced into the mechanical connection means there, with the linear bearing or rail adjusting system pulled out laterally, and is subsequently pushed into the housing of the single-pass inkjet printer. From there, the print head module is moved downward by means of the raising/lowering device into the printing position which is fixed to the unit. The removal takes place in the reverse sequence.

In principle, an individual raising/lowering device can be provided for each print head module. However, there is expediently a common raising/lowering device for all print head modules. In comparison with the multiple embodiment, a common raising/lowering device of this type requires a reduced number of mechanical components. The control is also simplified. A common raising/lowering device makes it possible, in particular, to remove all print head modules jointly out of their respective printing position which is fixed to the unit and to move them jointly into a cleaning position. As a result, the maintenance of the single-pass inkjet printer is simplified substantially.

In order to adjust the print head module into the respective printing position, catch means are preferably provided for a rough positioning of the print head modules which are running in, in particular dropping. A print head module which is connected, in particular, in a swinging manner will orient its centroid as a result of gravity during insertion. The catch means are then configured in such a way that they are capable of gripping any possible positioning elements of the print head module during the movement of the latter, in particular during lowering, and of prepositioning said print head module with respect to the printing position.

In one advantageous refinement, the catch means are formed by a catch wedge and a wedge shaft, one catch means part being mounted such that it is fixed to the unit and the other being mounted such that it is fixed to the module. If, for example, the catch wedge is mounted such that it is fixed to the unit, the wedge shaft which is mounted on the print head module receives first of all the wedge tip and subsequently the entire wedge during the gradual movement, in particular lowering into the printing position, as a result of which the print head module is restricted further in terms of its degrees of freedom which are still possible, for example an offset in the transverse direction or a swinging movement about the polar angle. Accordingly, the print head module is positively guided by the catch means to the subsequent stipulated printing position in a targeted manner.

In one particularly preferred refinement, the catch wedge is configured in each case as a catch elbow which is oriented in the running direction, the respective wedge shaft forming a substantially vertical slide guide with the catch elbow, and, on its insertion side, the wedge shaft comprising in each case one groove depression which is oriented in the running direction. This refinement refers, in particular, to the connection means of the print head module, which connection means is parallel to the transverse direction. Via the catch wedge which is oriented in the running direction, the polar angle is fixed increasingly during the movement of the print head module into the printing position. The print head module is fixed in the transverse direction via the groove depression which is oriented in the running direction.

Furthermore, in the printing position which is fixed to the unit, the print head modules are advantageously positioned in each case in at least two open bearings which are self-adjusting in the vertical direction and are offset in the transverse direction. In particular, if catch means are provided, the bearings which are self-adjusting in the vertical direction do not need to be of complicated construction. It is merely necessary that the two bearing elements which realize the bearing come together automatically during the gradual introduction of the print head module, as a result of which the final position is fixed ultimately. Suitable bearings are, for example, ball socket bearings, knife-edge bearings or conical bearings.

The parallel orientation of the print head module with respect to the transverse direction in the printing position is fixed finally via the offset of the two bearings in the transverse direction. Via the connection means and the two bearings which are offset in the transverse direction, the print head module is then fixed finally in the printing position which is fixed to the unit. The degrees of freedom are then reduced to zero.

In one preferred refinement, in each case one of the bearings which are offset in the transverse direction is configured as a locating bearing and the other of the bearings is configured as a floating bearing. For example, an expansion of the print head module in the transverse direction can be absorbed via the floating bearing. In one expedient refinement, in each case the locating bearing is configured as a ball pivot bearing and the floating bearing is provided by a prism slide guide in the transverse direction. The ball pivot bearing is advantageously equipped with a ball socket for punctiform rotary mounting, into which ball socket the spherical end of the pivot is received and positioned during the vertical introduction of the print head module. The prism slide guide is, in particular, likewise configured as a ball pivot bearing, the socket being configured, however, with a prism-shaped cross section along the transverse direction. The prism slide guide fixes the parallel position of the print head module with respect to the transverse direction. A linear offset is still possible as a degree of freedom in the transverse direction itself.

It is further preferred that, in the printing position which is fixed to the unit, the print head modules are positioned in each case in a self-adjusting open stop. The stop adjusts, for example, the inclination of the print head module about the polar angle, as long as the connection means does not completely restrict a degree of freedom in the running direction.

The stop is particularly advantageously formed by a ball pivot and by a stop face which is prestressed against the ball pivot in the running direction. In the case of a movement of the hanging print head module into the printing position, the ball pivot which is, for example, fixed to the module comes into contact gradually with the stop face which finally positions the ball pivot in the running direction. To this end, the stop face can be of spherical configuration, for example, and can act laterally against the ball pivot.

In the printing position, the respective print head module is then fixed exactly, for example, by the two open bearings, namely a ball pivot bearing as locating bearing and a prism slide guide as floating bearing, and by the stop.

If a stop is provided, the print head module can also, in particular, be raised out of the connection means in the final printing position. The print head module is then not positioned exactly in the running direction in the raised connection means. The stop then exclusively assumes this guidance. The position of the print head module in the printing position is then fixed exactly by the two self-adjusting open bearings and by the stop.

In order to make color or decorative pattern printing possible, a plurality of print head modules are arranged one behind another in the running direction in one advantageous refinement. Here, for the further improvement of the print quality, the print head modules are adjusted in the respective printing position along a vertically curved arc. This permits tauter guidance of the printing medium through the printing region.

It is further advantageous that a plurality of print head modules are arranged next to one another in the transverse direction. The printing width can be increased without great outlay by way of a modular refinement of this type. A further result of this refinement is an improvement in the statics of the single-pass printer. To this end, the individual print head modules are connected, for example, to a carrier which runs in the transverse direction, each module being mounted additionally remote from the carrier in the printing position.

In one expedient refinement of the single-pass inkjet printer, a cleaning module is provided for cleaning the print head modules, which cleaning module can be moved in below the raised print head modules in the running direction. Here, for cleaning purposes, the modules are raised in a simple way approximately vertically out of their respective printing position, which particularly advantageously takes place, in particular as mentioned, via a common raising/lowering device. In the raised cleaning position, the cleaning module is moved below the print head modules in the running direction. Subsequently, said print head modules can be lowered onto the cleaning module. As an alternative, the print head modules can also be lowered out of the printing position and can be raised into the latter. The individual nozzles of the print heads are then cleaned. The removal of the cleaning module and the repositioning of the print head modules then take place in the reverse order.

In order to make a particularly simple construction of the single-pass inkjet printer and exchange of the respectively used print head modules possible, the bearing points of the printer are adjusted exactly for all print head modules. The print heads of the print head modules are then already positionally adjusted in advance with respect to the predefined printing position. A positional adjustment of this type takes place, for example, by a tool being provided which reproduces the bearing points of the single-pass inkjet printer. Every print head module to be delivered is inserted into said tool. The print heads on the print head module are subsequently oriented exactly with respect to the tool and therefore with respect to the single-pass inkjet printer. This takes place, for example, by optical microscope.

As a result of the preadjustment of the print heads of the print head modules to the later printing position, extremely simple and time-saving assembly of the printer itself and likewise simple and time-saving exchange of print head modules at the place of use of the single-pass inkjet printer are made possible.

BRIEF DESCRIPTION OF THE DRAWINGS

Exemplary embodiments of the invention will be explained in greater detail using a drawing, in which.

DETAILED DESCRIPTION

Figure 1:
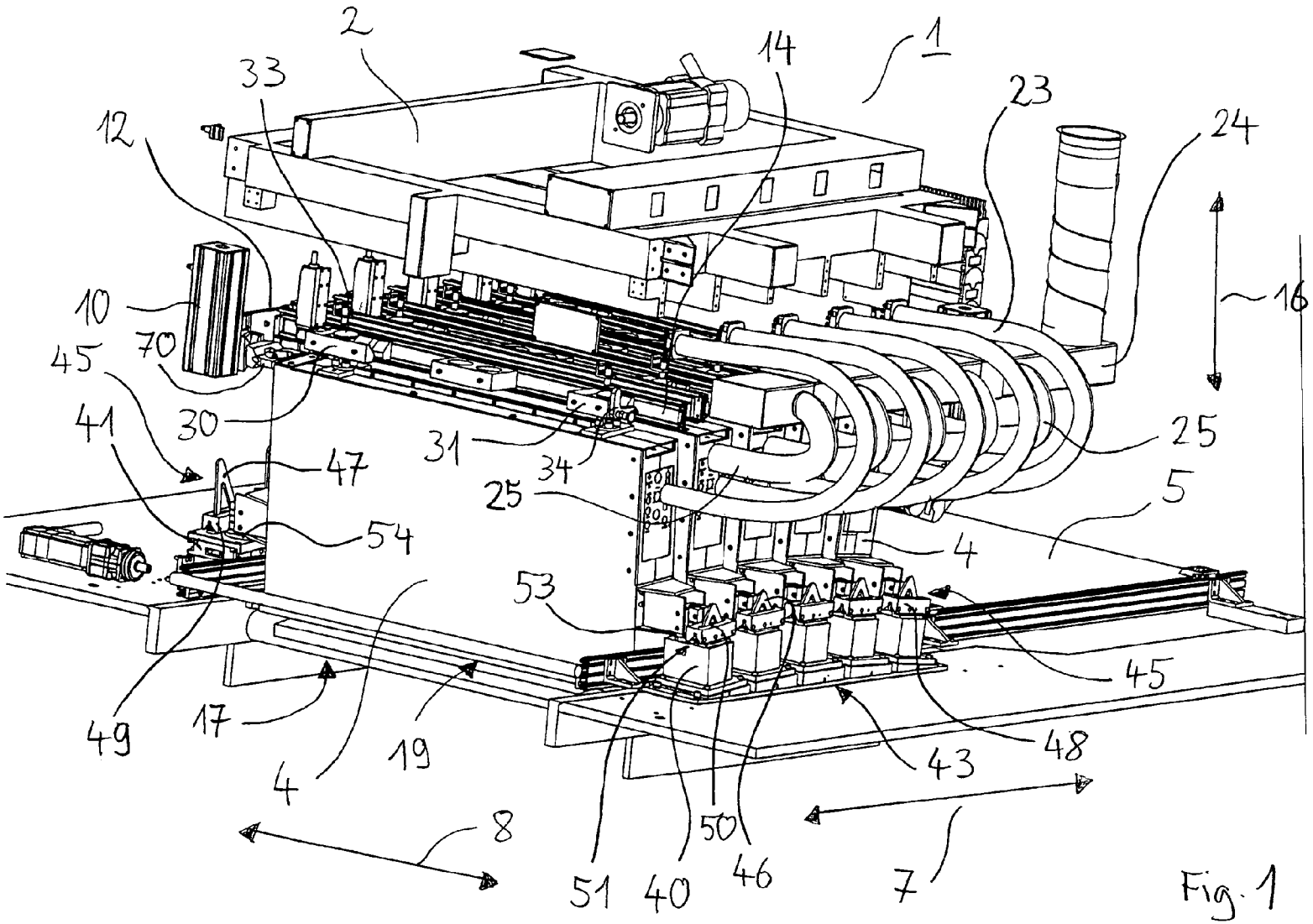
FIG. 1 shows an illustration of a single-pass inkjet printer, which illustration shows the essential parts.

FIG. 1 shows a three-dimensional illustration of a single-pass inkjet printer 1 omitting parts which are not essential. The single-pass inkjet printer comprises a housing 2, in which a number of print head modules 4 are arranged in a printing position which is fixed to the unit. Furthermore, a running track 5 is provided for guiding a printing medium along a running direction 7. The print head modules 4 are arranged one behind another in the running direction and extend over the width of the running track 5 in a transverse direction 8. The individual elements which are shown of the single-pass printer 1 are fastened in each case to frame elements 10. For the sake of clarity, only a small part of the frame elements 10 is shown.

The total of five print head modules 4 are arranged one behind another in the running direction 7 and are fastened in a hanging manner to a raising/lowering device 12 in the respectively shown printing position which is fixed to the unit. The raising/lowering device 12 can be moved overall in the vertical direction 16 along the frame elements 10.

Each of the print head modules 4 is provided to print one color. In the present case, the colors cyan, magenta, yellow and black and a special color are realized by the five print head modules 4. Each of the print head modules 4 is connected to the raising/lowering device 12 via a rail adjusting system such that it can be displaced in the transverse direction 8. A plurality of print heads which result in a printing region which extends over the entire width of the printing medium are mounted on the underside 17 of each print head module 4. Here, the individual print heads are offset alternately in the running direction 7 with respect to one another, with the result that the nozzles of each print head ensure a continuous printing region in the transverse direction 8. This arrangement can be seen, for example, from FIG. 6.

In order to print a printing medium, the latter—as illustrated by the arrow 19—is moved continuously in the running direction 7 along the running track 5 under the individual print head modules 4. Via the mounting of the print head modules 4 which will be explained in greater detail in the following text, the individual nozzles of the print heads are adjusted in the range of a few micrometers in relation to the housing 2.

In addition to the print heads, each print head module 4 contains the corresponding electronic actuation means and optionally a storage tank for ink. The actuation of the individual print heads of each print head module 4 takes place via a central controller. Here, the central controller is connected to each print head module 4 via a central supply line which cannot be seen and from which corresponding lines 23 branch off. In addition to electric feed lines, ink supply lines are, in particular, also contained in said lines, which ink supply lines resupply intermediate tanks in the print head modules 4 with ink. Furthermore, there is an air duct 24, from which air lines 25 into the respective print head modules 4 branch off. By way of the air lines 25, air circulation is brought about in the print head modules 4, in order to keep dust away. In particular, a positive pressure is generated in the interior of the print head modules 4 via the air lines.

Each of the print head modules 4 is connected in a swinging manner to the rail adjusting system 14 which can be extended in the transverse direction 8, via a first and a second open ball socket bearing 30 and 31. Here, the first and the second ball socket bearing 30 and 31 are arranged offset in the transverse direction 8 with respect to one another. The sockets of both ball socket bearings 30, 31 are configured in each case as prism sockets which are open to the bottom and run in the transverse direction 8. In order to connect the print head modules 4, both prism sockets are additionally in each case open on a removal side. The print head modules 4 are connected in each case in a swinging manner into the prism sockets of both ball socket bearings 30, 31 via a bearing element which is configured as a cone 33. Each print head module 4 is secured against being pushed out unintentionally by a closure lever 34.

The arrangement, offset in the transverse direction 8, of the two ball socket bearings 30, 31 which are fastened in each case to the adjustable part of the rail adjusting system 12 already results in basic fixing of the print head modules 4 parallel to the transverse direction 8 with the retention of certain degrees of freedom. Each print head module 4 remains displaceable in the transverse direction 8 itself. Each print head module 4 can swing about a polar angle by way of the connection means which is configured as an open ball socket bearing 30 or 31. As a result, firstly simple positioning of the print head modules 4 into the printing position which is fixed to the unit is achieved. Secondly, this swinging connection allows the setting of an inclination of a print head module 4 with respect to the running direction 7, as becomes necessary in the case of arcuate guidance, as shown, of the printing medium through the printing region.

All the print head modules 4 can be raised jointly in the vertical direction 16 upward out of the illustrated printing position via the raising/lowering device 12, on which the respective rail adjusting systems 14 are mounted parallel to the transverse direction 8. In the raised position, the print head modules 4 can be moved out to the front right according to FIG. 1 by means of the rail adjusting system 14. A position of this type is shown, for example, in FIG. 6. After the respective closure lever 34 is opened, simple removal of the respective print head module 4 from the ball socket bearings 30, 31 is then possible. The insertion of a print head module 4 into the single-pass inkjet printer 1 takes place in the reverse order.

Positioning blocks 40 and 41 are arranged in each case on both sides of the running track 5 on the housing 2 of the single-pass inkjet printer 1 for a self-adjusting introduction of the print head modules 4 into the respective position shown which is fixed to the unit. The positioning blocks 40 are manufactured to be solid. The positioning blocks 41 comprise two linear tables which are arranged one above another and can be set or adjusted in the transverse direction 8 or in the running direction 7. One-time setting up of the positioning blocks 41 for the respective fixing of the printing position can be achieved via said adjustable tables. As a result, in particular, production-induced dimensional tolerances can be compensated for. The positioning blocks 40, 41 are arranged in each case along an upwardly curved arc 43. As a result, reference is made to corresponding arcuate guidance of the printing medium through the printing region. Arcuate guidance of this type permits more exact fixing of the printing medium.

Catch means 45 are mounted in each case on the respective positioning blocks 40, 41 for rough positioning of the dropping print head modules 4 for gradually fixing the final printing position. Here, the catch means 45 comprise in each case one catch wedge 46 and 47 which is mounted fixedly on the unit and communicates with a respective wedge shaft 48 and 49 which is mounted on the print head module 4. Here, the catch wedges 46 and 47 are configured in each case as catch elbows which are oriented parallel to the running direction 7 and have an upwardly tapering tip. Here, the wedge shaft 48 and 49 and the catch wedge 46 and 47 in each case form a slide guide 50 in the vertical direction 16.

In the raised position of the raising/lowering device 12, a connected print head module 4 swings about a polar angle. Here, the print head module 4 is oriented substantially vertically as a result of the action of gravity. Moreover, each print head module 4 is oriented substantially parallel to the transverse direction 8 by way of the connection in the two ball socket bearings and 31. During the further lowering, the wedge shafts 48 and 49 on both sides of a print head module 4 first of all slide on the corresponding catch wedges 46 and 47. Here, the dropping print head module 4 is first of all oriented roughly in the transverse direction 8 by way of the groove depressions 51 which are made in the running direction 7 on the underside of each wedge shaft 48 and 49. Subsequently, each wedge shaft 48 and 49 can slide onto the respective catch wedge 46 and 47. Here, gradual setting of the desired inclination of the print head module 4 also takes place by way of the respective slide guide 50, on account of the angular shape of the catch wedges 46, 47.

As a result of the rough positioning, achieved by means of the catch means 45, of a dropping print head module 4, the latter is moved during further lowering finally into the exact printing position which is fixed to the unit. To this end, in each case ball pivot bearings 53 which are open at the top are configured on one side of each print head module 4 and prism slide guides 54 which are open at the top are configured on the other side. Here, in each case ball pivots with downwardly directed balls at the end are configured on both sides of each print head module 4. During the final lowering of a print head module 4, the balls are finally fixed in the ball pivot bearing 53 in a ball socket and in the prism slide guide 54 in a prism socket 59 which is oriented in the transverse direction 8. Here, the bearing elements 33 are raised out of the ball socket bearings 30, 31.

The ball pivot bearings 53 on the right-hand side (according to FIG. 1) of each print head module 4 form a three-dimensionally fixed pivot point in the final printing position. The prism slide guides 54 on the other side of the print head modules 4 fix the parallelism of the print head modules 4 with respect to the transverse direction 8 exactly. Secondly, the prism slide guides 54 still permit an offset parallel to the transverse direction 8 as a degree of freedom. The two ball pivot bearings 30 and 31 of the mechanical connection means fix the inclination or polar angle of the print head modules 4 in the raised position at least roughly.

In addition, a stop 70 which is attached on one side is provided at the upper end of the respective print head modules 4. During the lowering of the respective print head module 4, a ball pivot which is fixed to the module comes into contact with a spherical stop face which is fixed to the printer and is prestressed in the running direction 7. When the final printing position is reached, the inclination angle of each print head module 4 is oriented exactly. Overall, each print head module 4 is therefore oriented, fixed and adjusted exactly in the printing position which is fixed to the unit.

The stop 70 is in principle not necessary. Optionally in addition or as an alternative to the connection means, it assists and defines the fixing of the upper end of the print head modules 4 in the running direction 7. For example, in the case of a knife-edge bearing as connection means, the inclination angle of the print head modules 4 is already fixed exactly by the bearing despite the swinging connection.

As a result of the provided design of the respective bearing points, each print head module 4 can be raised out of the fixed printing position in a simple way by being raised in the vertical direction. Secondly, exact fixing of the printing position takes place exclusively by gradual lowering of the hanging print head modules 4. The single-pass inkjet printer 1 therefore permits extremely rapid realignment and extremely rapid and simple exchange of the print head modules 4. Without protracted time spent on adjusting an exchanged print head module 4, the exact printing position is achieved exclusively and automatically by lowering in the case of the single-pass inkjet printer 1 shown here, as a consequence of the self-adjusting bearings and the illustrated connection of the print head modules 4. Manual readjusting of the exchanged print head modules 4 can be dispensed with completely. The down times of the single-pass inkjet printer 1 are shortened considerably in comparison with conventional single-pass inkjet printers.

Figure 2:
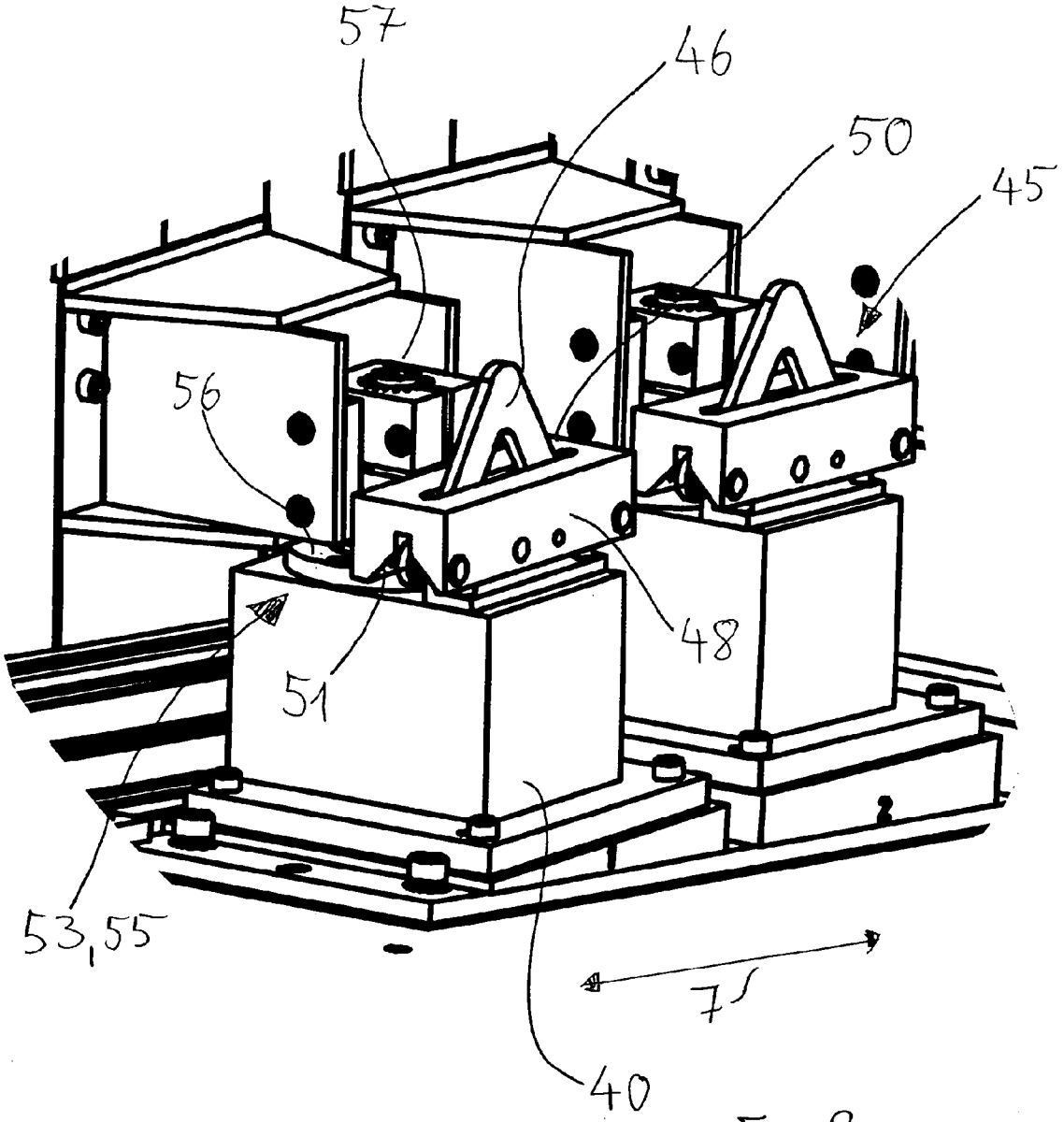
FIG. 2 shows a first detailed view from FIG. 1.

FIG. 2 shows a detailed view of the ball pivot bearing 53 according to FIG. 1, which ball pivot bearing 53 is configured as a locating bearing 55. The wedge shaft 48 which is fastened to the print head module 4 can now be seen clearly, which wedge shaft 48 has, on its underside, a prism depression 51 which is oriented in the running direction 7. The conical socket 56 which is mounted fixedly to the unit can likewise be seen, into which conical socket 56 the spherical end of the ball pivot 57 is finally fixed during lowering of the print head module 4. The ball pivot 57 is mounted such that its height can be adjusted in the micrometer range, with the result that dimensional tolerances, etc. can be compensated for on the single-pass inkjet printer 1.

Figure 3:
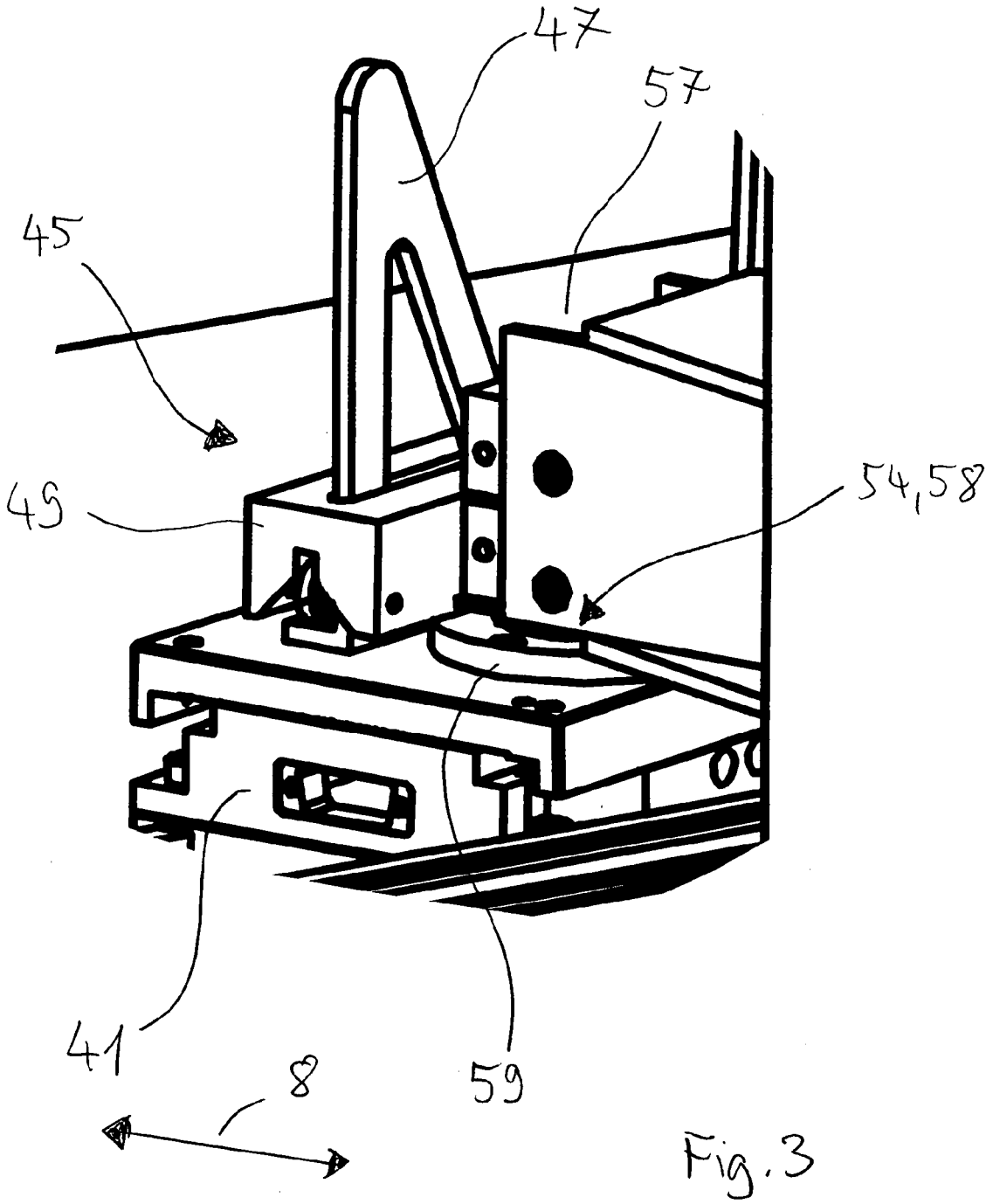
FIG. 3 shows a second detailed view from FIG. 1.

FIG. 3 shows a detailed view of the prism slide guide according to FIG. 1, which prism slide guide 54 forms a floating bearing 58. The catch wedge 47 and the wedge shaft 49 can once again be clearly seen. The two linear tables of a positioning block 41 can also be seen. The prism socket 59 can be seen, the wedge-shaped indent of which is oriented parallel to the transverse direction 8. The spherical end of the ball pivot 57 drops into said prism socket 59 during lowering of the print head module 4. As a result, an exact position is fixed finally in the running direction 7. A linear offset is still possible in the transverse direction 8. The ball pivot 57 is once again mounted such that its height can be adjusted.

Figure 4:
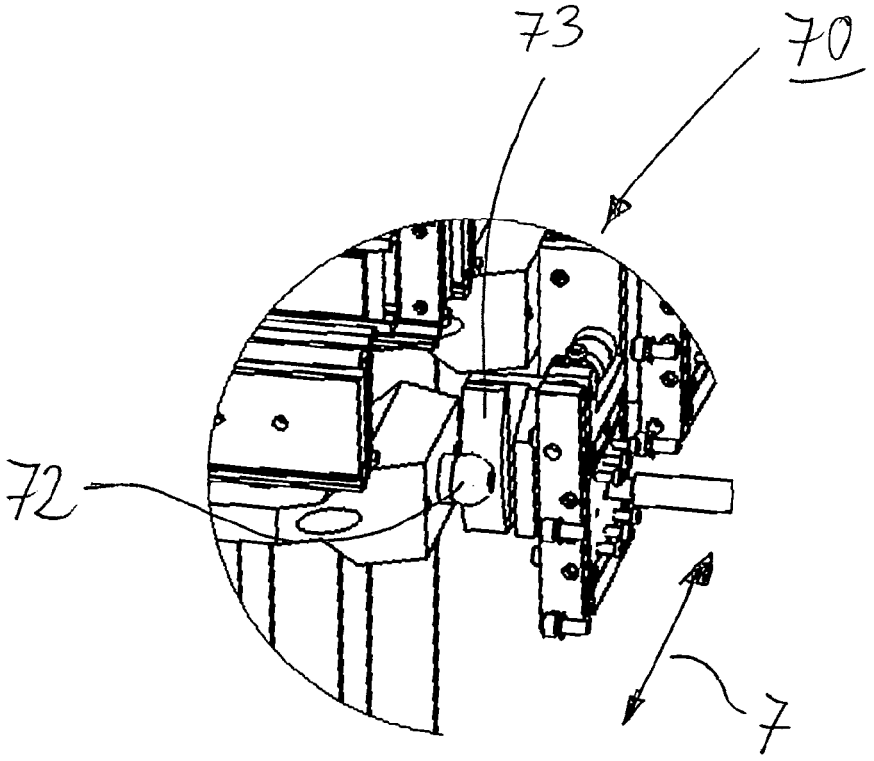
FIG. 4 shows a third detailed view from FIG. 1.

FIG. 4 shows a detailed view of the stop 70 according to FIG. 1, but is shown mirror-inverted with respect thereto. The ball pivot 72 which is fixed to the module can be seen, which ball pivot 72, in the printing position of the print head module, bears against a spherical stop face 73 which is fixed to the printer and is prestressed in the running direction. For improved clarity, those parts are removed in FIG. 4 which prevent the visibility of the ball pivot 73. The stop face is configured such that it can be adjusted in the running direction 7.

Figure 5:
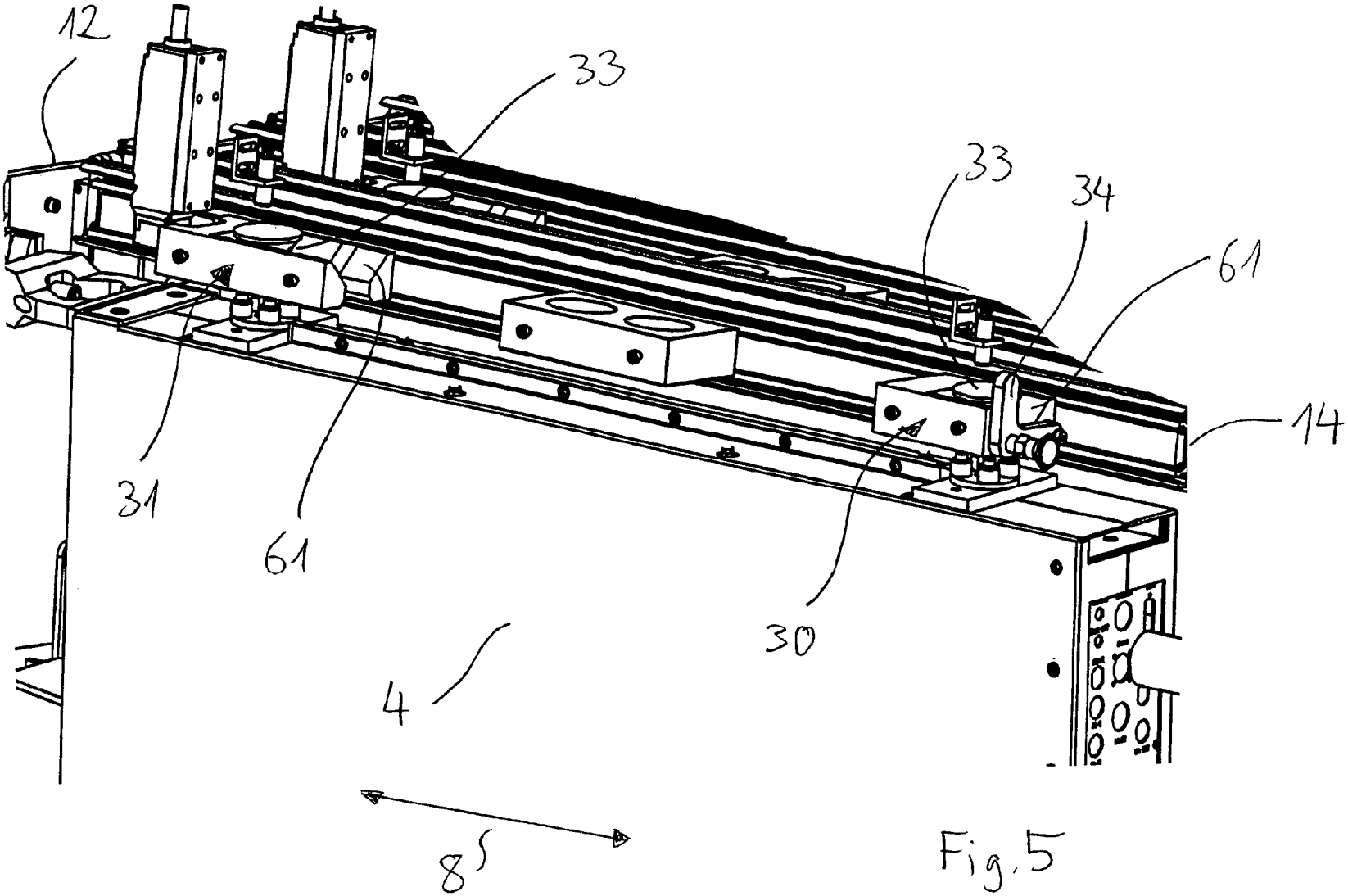
FIG. 5 shows a fourth detailed view from FIG. 1.

The connection of a print head module 4 can be seen from FIG. 5 in a further detailed view from FIG. 1. To this end, a rail adjusting system 14 is mounted on a raising/lowering device 12 in the transverse direction 8. A first open ball socket bearing 30 and a second open ball socket bearing 31 are mounted on the adjustable rail of the rail adjusting system 14 at two points which are offset in the transverse direction 8. The sockets of both ball socket bearings 30 and 31 are configured as a prism sockets 61 which are open at the bottom. Both prism sockets 61 are open in each case on one side in the transverse direction 8. The print head module 4 can be connected in the transverse direction 8 via said opening by means of bearing elements of the raising/lowering device 12 which are configured as cones 33. A closure lever 34 is mounted on the first ball socket bearing 30 to prevent unintentional pushing or pulling out.

The print head module 4 is oriented substantially in the transverse direction 8 by the two ball socket bearings 30 and 31. An offset is possible along the transverse direction 8. The two mechanical connections which are shown permit a swinging movement of the print head module 4 about a polar angle. The freely hanging print head module 4 can be oriented freely under the action of gravity.

Figure 6:
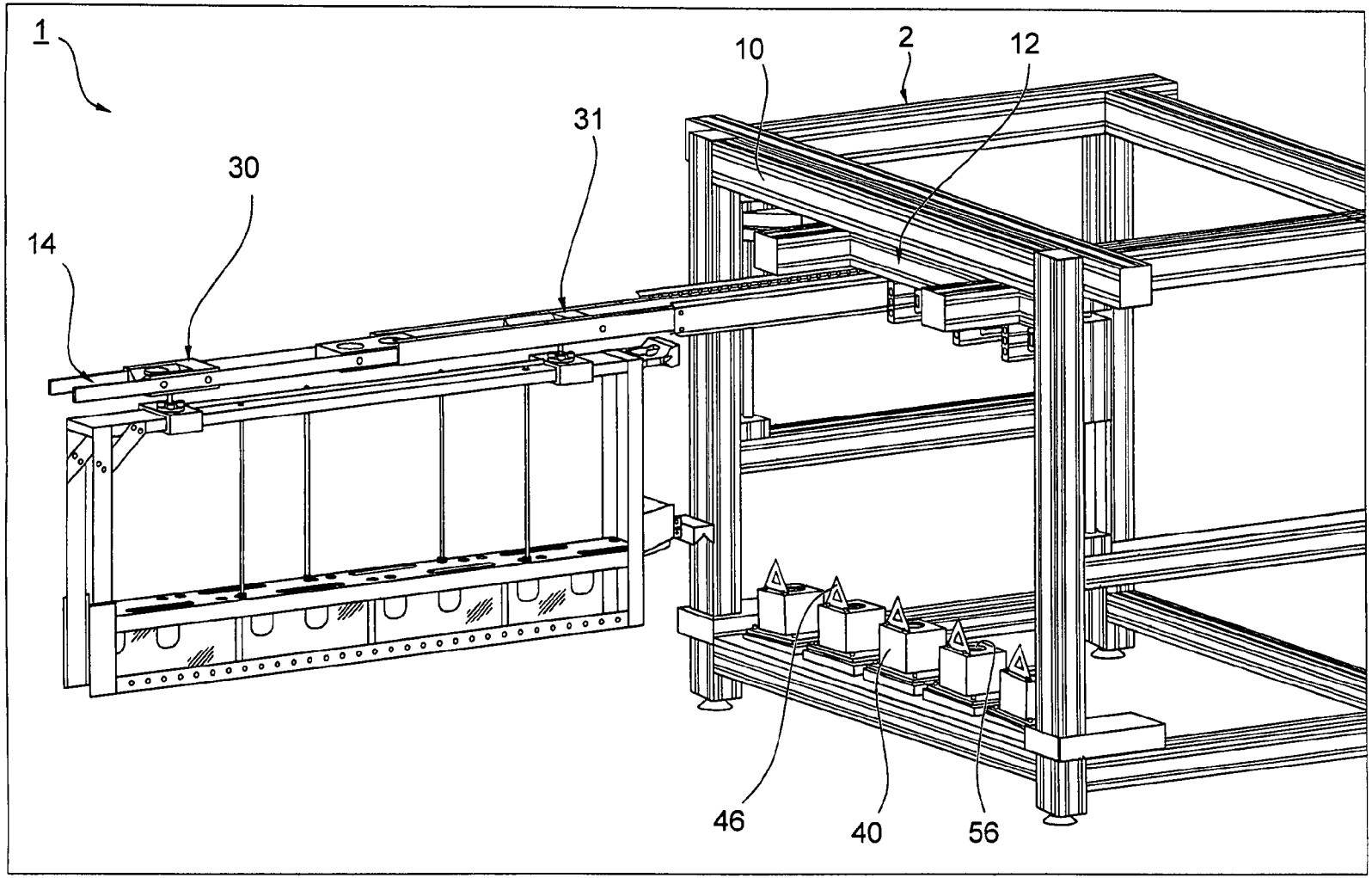
FIG. 6 shows the single-pass inkjet printer according to FIG. 1 with a print head module which has been moved into the removal position.

FIG. 6 shows the single-pass inkjet printer 1 according to FIG. 1 in a pulled-out removal position for a print head module 4. The frame elements 10 can be seen in their entirety in FIG. 5. The positioning blocks 40 can also be readily seen with the conical sockets 56 and catch wedges 46 mounted on said positioning blocks 40.

The rail adjusting system 14 is mounted overall on the raising/lowering device 12. The latter is situated as shown in a raised removal position. In this position, the rail adjusting system 14 of a print head module 4 is pulled out laterally. The print head module 4 is fastened in a hanging manner to the adjustable rail by means of two ball socket bearings 30 and 31. Easy removal of the print head module 4 is possible in the laterally moved-out position which is shown.

It can be seen overall that the single-pass inkjet printer 1 makes simple modular exchange of the print head modules 4 possible. The down times of the single-pass inkjet printer 1 are shortened to an extreme extent as a result of the simple manual removability or reinsertability and as a result of the above-described self-adjustment of the print head modules 4 during lowering.

In the raised removal position of the raising/lowering device 12, which removal position can be seen from FIG. 6, the undersides of the respective print head modules 4 are situated at a spacing from the running track 5 for the printing medium. This allows a cleaning module (not shown) to be moved in along the running track 5. The print heads which are attached on the underside of the print head modules 4 are brought into contact with the cleaning module by way of renewed lowering of the raising/lowering device 12. The cleaning of the individual nozzles takes place subsequently. Finally, the raising/lowering device 12 is raised again and the cleaning module is removed in the running direction 7.

Figure 7:
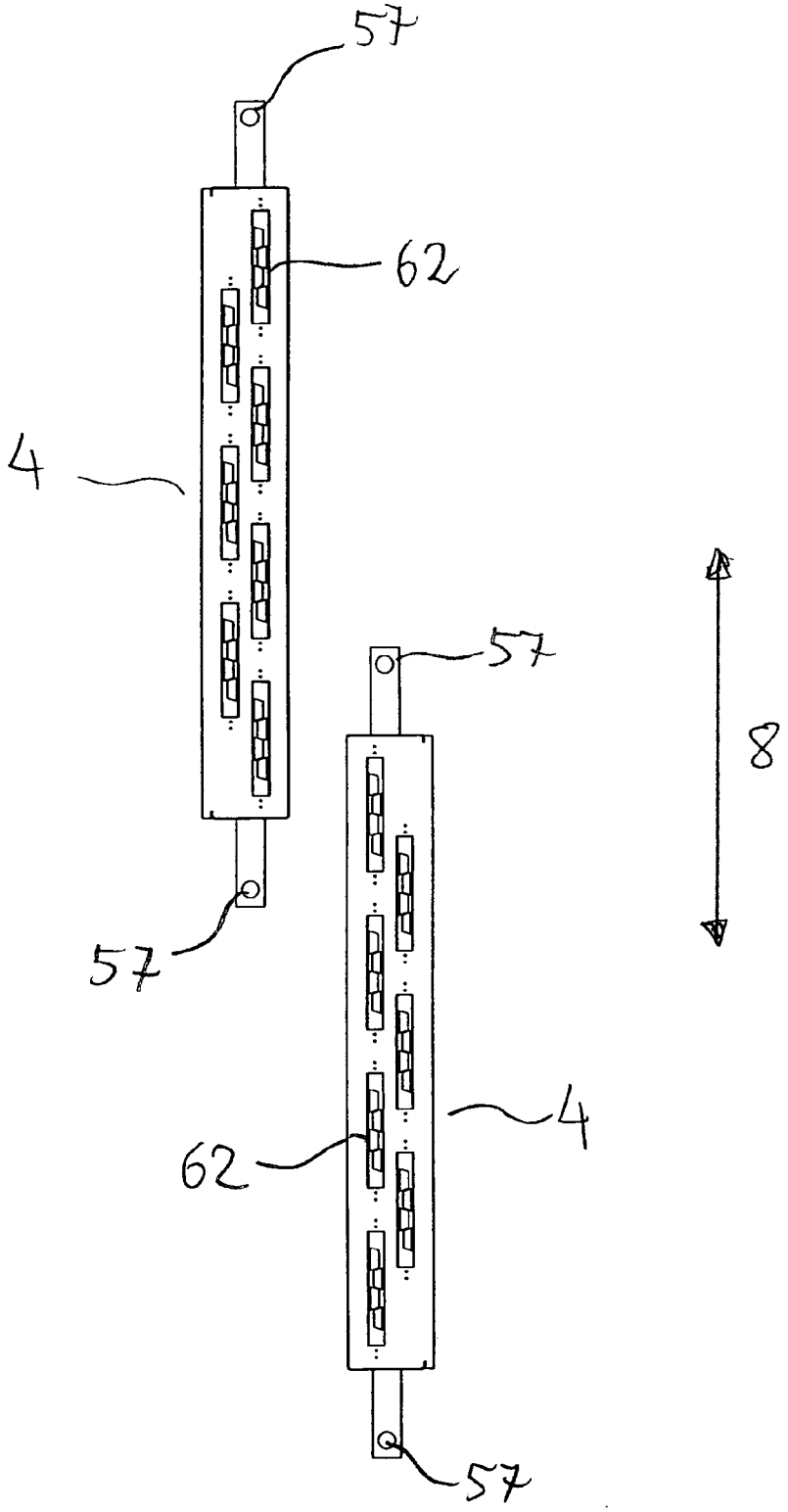
FIG. 7 shows two print head modules which are arranged next to one another from below.

FIG. 7 diagrammatically shows the underside of two print head modules 4 which are arranged next to one another in the transverse direction 8. In each case the ball pivots 57 which are provided for self-adjustment can be seen on both sides of the print head modules 4. Print heads 62 which extend along the transverse direction 8 are installed on the underside. Here, the print heads are offset in the running direction 7 with respect to one another. The overlap which results ensures that there is a uniform arrangement of nozzles over the entire width of the print head module 4. Here, reference is made to the fact that each print head 62 comprises a certain frame construction, in which no nozzles are arranged.

The two print head modules 4 are likewise arranged so as to overlap in the transverse direction 8, with the result that there is an arrangement of nozzles which is uniform over the entire width 8 of the printing medium, even with the inclusion of both print head modules 4. The width of the printing medium can be extended simply in a modular manner by way of the arrangement of the print head modules 4 next to one another.

The invention claimed is:

1. A single-pass inkjet printer having a running track for guiding a printing medium along a running direction and having a number of print head modules which extend over the running track in a transverse direction, characterized in that, the print head modules are hanging in each case substantially in the vertical direction oriented by gravity, the print head modules can be moved in a self-adjusting manner into a printing position which is fixed to the printer and are arranged such that they can be removed reversibly from the printing position which is fixed to the printer, and the print head modules are fastened in each case in a swinging manner to a raising/lowering device.

2. The single-pass inkjet printer as claimed in claim 1, characterized in that the print head modules are fastened in each case in an upright state in the printing position which is fixed to the printer.

3. The single-pass inkjet printer as claimed in claim 1, characterized in that the print head modules are connected in each case to the raising/lowering device parallel to the transverse direction and are arranged so as to swing about a polar angle.

4. The single-pass inkjet printer as claimed in claim 1, characterized in that the print head modules are connected to the raising/lowering device in each case via at least two open ball socket bearings which are offset in the transverse direction.

5. The single-pass inkjet printer as claimed in claim 1, characterized in that the print head modules are fastened to the raising/lowering device such that they can be displaced in each case in the transverse direction.

6. The single-pass inkjet printer as claimed in claim 1, characterized in that a common raising/lowering device is provided for all print head modules.

7. The single-pass inkjet printer as claimed in claim 1, characterized in that catch means are provided for the rough positioning of the print head modules, in each case, during their insertion into the printing position which is fixed to the printer.

8. The single-pass inkjet printer as claimed in claim 7, characterized in that the catch means are formed by a catch wedge and a wedge shaft, one catch means part being mounted such that it is fixed to the printer and the other being mounted such that it is fixed to the module.

9. The single-pass inkjet printer as claimed in claim 8, characterized in that the catch wedge is configured as a catch elbow which is oriented in the running direction, in that the wedge shaft forms a substantially vertical slide guide with the catch elbow, and in that, on its insertion side, the wedge shaft comprises in each case one groove depression which is oriented in the running direction.

10. The single-pass inkjet printer as claimed in claim 1, characterized in that, in the printing position which is fixed to the printer, the print head modules are positioned in each case in at least two open bearings which are self-adjusting in the vertical direction and are offset in the transverse direction.

11. The single-pass inkjet printer as claimed in claim 10, characterized in that in each case one of the bearings is configured as a locating bearing and the other bearing is configured as a floating bearing.

12. The single-pass inkjet printer as claimed in claim 11, characterized in that in each case the locating bearing is configured as a ball pivot bearing and the floating bearing is provided by a prism slide guide in the transverse direction.

13. The single-pass inkjet printer as claimed in claim 1, characterized in that, in the printing position which is fixed to the printer, the print head modules are positioned in each case in a self-adjusting open stop.

14. The single-pass inkjet printer as claimed in claim 13, characterized in that the stop comprises a ball pivot and a stop face which is prestressed against the ball pivot in the running direction.

15. The single-pass inkjet printer as claimed in claim 1, characterized in that a plurality of print head modules are arranged one behind another in the running direction, the print head modules being adjusted in the respective printing position in each case perpendicularly with respect to the track course of the printing medium.

16. The single-pass inkjet printer as claimed in claim 1, characterized in that a plurality of print head modules are arranged next to one another in the transverse direction.

17. The single-pass inkjet printer as claimed in claim 1, characterized in that a cleaning module is provided for cleaning the print head modules, which cleaning module can be moved in below the raised print head modules in the running direction.

18. The single-pass inkjet printer as claimed in claim 1, characterized in that the print head modules in each case have a number of print heads which are adjusted positionally with respect to the printing position.

19. The single-pass inkjet printer as claimed in claim 1, characterized in that:

the print head modules are fastened in each case in an upright state in the printing position which is fixed to the printer;

catch means are provided for the rough positioning of the print head modules which in each case run, in particular drop, into the printing position which is fixed to the printer;

in the printing position which is fixed to the printer, the print head modules are positioned in each case in at least two open bearings which are self-adjusting in the vertical direction and are offset in the transverse direction;

in the printing position which is fixed to the printer, the print head modules are positioned in each case in a self-adjusting open stop;

a plurality of print head modules are arranged one behind another in the running direction, the print head modules being adjusted in the respective printing position in each case perpendicularly with respect to the track course of the printing medium;

a plurality of print head modules are arranged next to one another in the transverse direction;

a cleaning module is provided for cleaning the print head modules, which cleaning module can be moved in below the raised print head modules in the running direction; and the print head modules in each case have a number of print heads which are adjusted positionally with respect to the printing position.

20. The single-pass inkjet printer as claimed in claim 19, characterized in that:

the print head modules are connected in each case to the raising/lowering device parallel to the transverse direction and are arranged so as to swing about a polar angle;

the print head modules are connected to the raising/lowering device in each case via at least two open ball socket bearings which are offset in the transverse direction;

the print head modules are fastened to the raising/lowering device such that they can be displaced in each case in the transverse direction;

a common raising/lowering device is provided for all print head modules;

the catch means are formed by a catch wedge and a wedge shaft, one catch means part being mounted such that it is fixed to the printer and the other being mounted such that it is fixed to the module;

the catch wedge is configured as a catch elbow which is oriented in the running direction, in that the wedge shaft forms a substantially vertical slide guide with the catch elbow, and in that, on its insertion side, the wedge shaft comprises in each case one groove depression which is oriented in the running direction;

in each case one of the bearings is configured as a locating bearing and the other bearing is configured as a floating bearing;

in each case the locating bearing is configured as a ball pivot bearing and the floating bearing is provided by a prism slide guide in the transverse direction; and the stop comprises a ball pivot and a stop face which is prestressed against the ball pivot in the running direction.

21. The single-pass inkjet printer as claimed in claim 1, characterized in that each print head module comprises a plurality of print heads, each print head comprising a plurality of nozzles.

22. A single-pass inkjet printer having a running track for guiding a printing medium along a running direction and having a number of print head modules which extend over the running track in a transverse direction, characterized in that:

the print head modules are hanging in each case substantially in the vertical direction oriented by gravity;

the print head modules can be moved in a self-adjusting manner into a printing position which is fixed to the printer and are arranged such that they can be removed reversibly from the printing position which is fixed to the printer;

catch means are provided for the rough positioning of the print head modules, in each case, during their insertion into the printing position which is fixed to the printer; and the catch means are formed by a catch wedge and a wedge shaft, one catch means part being mounted such that it is fixed to the printer and the other being mounted such that it is fixed to the module.

23. The single-pass inkjet printer as claimed in claim 22, characterized in that the catch wedge is configured as a catch elbow which is oriented in the running direction, in that the wedge shaft forms a substantially vertical slide guide with the catch elbow, and in that, on its insertion side, the wedge shaft comprises in each case one groove depression which is oriented in the running direction.

24. A single-pass inkjet printer having a running track for guiding a printing medium along a running direction and having a number of print head modules which extend over the running track in a transverse direction, characterized in that:

the print head modules are hanging in each case substantially in the vertical direction oriented by gravity;

the print head modules can be moved in a self-adjusting manner into a printing position which is fixed to the printer and are arranged such that they can be removed reversibly from the printing position which is fixed to the printer; and in the printing position which is fixed to the printer, the print head modules are positioned in each case in at least two open bearings which are self-adjusting in the vertical direction and are offset in the transverse direction.

25. The single-pass inkjet printer as claimed in claim 24, characterized in that in each case one of the bearings is configured as a locating bearing and the other bearing is configured as a floating bearing.

26. The single-pass inkjet printer as claimed in claim 25, characterized in that in each case the locating bearing is configured as a ball pivot bearing and the floating bearing is provided by a prism slide guide in the transverse direction.

27. A single-pass inkjet printer having a running track for guiding a printing medium along a running direction and having a number of print head modules which extend over the running track in a transverse direction, characterized in that:

the print head modules are hanging in each case substantially in the vertical direction oriented by gravity;

the print head modules can be moved in a self-adjusting manner into a printing position which is fixed to the printer and are arranged such that they can be removed reversibly from the printing position which is fixed to the printer;

in the printing position which is fixed to the printer, the print head modules are positioned in each case in a self-adjusting open stop; and the stop comprises a ball pivot and a stop face which is prestressed against the ball pivot in the running direction.

* * * * *